United States Patent [19]

Karlan

[11] Patent Number: 4,610,223

[45] Date of Patent: Sep. 9, 1986

[54] CAM ENGINE

[76] Inventor: Paul Karlan, 511 Center Ave., Mamaroneck, N.Y. 10543

[21] Appl. No.: 722,515

[22] Filed: Apr. 12, 1985

Related U.S. Application Data

[63] Continuation-in-part of Ser. No. 646,857, Sep. 4, 1984.

[51] Int. Cl.[4] ..... F02B 75/26

[52] U.S. Cl. ..... 123/58 AM; 123/190 BA

[58] Field of Search ..... 123/58 R, 58 A, 58 AM, 123/80 BB, 190 BA

[56] References Cited

U.S. PATENT DOCUMENTS 3,456,630 7/1969 Karlan ..... 123/50 AM

FOREIGN PATENT DOCUMENTS 2510101 9/1975 Fed. Rep. of Germany ..... 123/190 BA

*Primary Examiner*—Craig R. Feinberg

*Attorney, Agent, or Firm*—Charles E. Temko

[57] ABSTRACT

An improved internal combustion cam engine of a type in which the drive-cam-valve shaft rotates about an axis parallel to the axes of the cylinders.

2 Claims, 5 Drawing Figures

CAM ENGINE

This application is a continuation-in-part of my copending application Ser. No. 06/646,857, filed Sept. 4, 1984 under the same title still pending.

BACKGROUND OF THE INVENTION

This invention relates generally to the field of internal combustion engines, and more particularly to an improved cam engine of a type in which the usual crank shaft is eliminated, and the pistons, and associated connecting rods transmit motion to a rotating cam element having an axis of rotation parallel to the line of action of the pistons. Reference is made to my prior U.S. Pat. No. 3,805,749 which discloses a cam engine of this general type, the present disclosure relating to an improved form of that engine.

While inherently functional in its original form, I have found that certain structural elements thereof are capable of substantial improvement.

One problem has been that of maintaining the operational temperature of the disk intake-exhaust valve within reasonable limits. Unlike poppet type valves, the disk valve of the engine disclosed in my prior patent is not located in a cooling medium, and is not easily cooled by water jacketing. Since the clearance between the valve and its housing must be maintained within relatively small limits to preserve compression, overheating can cause sufficient expansion to result in seizing of the valve against its housing.

Another problem which I have encountered is that of igniting the fuel mixture in those cylinders which do not have a spark plug. In my earlier construction, the ignition was accomplished by a passage connecting opposed cylinders which fired simultaneously and extended through the disk valve. This has caused a heating effect on the disk valve, and its clearance with the housing.

At high speeds, it becomes desirable to provide more rapid opening and closing of the intake and exhaust valve cycles within the same degree of rotation of the drive shaft. This cannot be accomplished by altering cam lobes as in a conventional poppet valve engine, but the desired result is necessary for efficiency at such high speeds.

Since there is no pivotal interconnection between the connecting rod and piston in each of the individual cylinders, owing to the lack of a crankshaft, it is desirable to provide means whereby an individual piston has a degree of ability to correct for misalignment relative to the connecting rods, and thereby avoid unnecessary pressure on the adjacent cylinder walls.

Finally, it is desirable to reduce friction at the points of communication between the cams on the cam plate connected to the lower end of the connecting rods and the corresponding cam lobe on the cam element which drives the motion output shaft.

SUMMARY OF THE INVENTION

Briefly stated, the invention contemplates the provision of improvements in my prior cam engine for accomplishing the above-mentioned ends. To cool the disk valve, provision is made for guiding the vaporized fuel mixture through passages of increased length in the disk valve to absorb heat therefrom. This also results in heating the fuel mixture prior to combustion, which is normally desirable in internal combustion engines.

Provision is made for pairs of simultaneously fired spark plugs to provide faster ignition. The existing connecting passage is maintained between the cylinders to assist in heating the disk valve housing to maintain clearances with the disk valve.

Within the disk valve, the intake and exhaust ports are configured so that a pair of opposed sides are angled for quick opening and closing with respect to the same degree of valve rotation.

Improved interconnecting structure between pistons and connecting rods is provided so that the pistons can readily align with the principal axis thereof to avoid side pressure against a cylinder wall.

Finally, the cam surfaces on the cam lobes of the cam element are frusto-conical in configuration, with the apex thereof lying in the axis of rotation of the output shaft to facilitate the rotation of corresponding cam followers on a plate secured to the lower ends of connecting rods, thereby facilitating the reduction of internal friction during operation.

These objects, as well as other incidental ends and advantages, will more fully appear in the progress of the following disclosure, and be pointed out in the appended claims.

BRIEF DESCRIPTION OF THE DRAWINGS

In the drawings, to which reference will be made in the specification.

DETAILED DESCRIPTION OF THE DISCLOSED EMBODIMENTS

Figure 1:
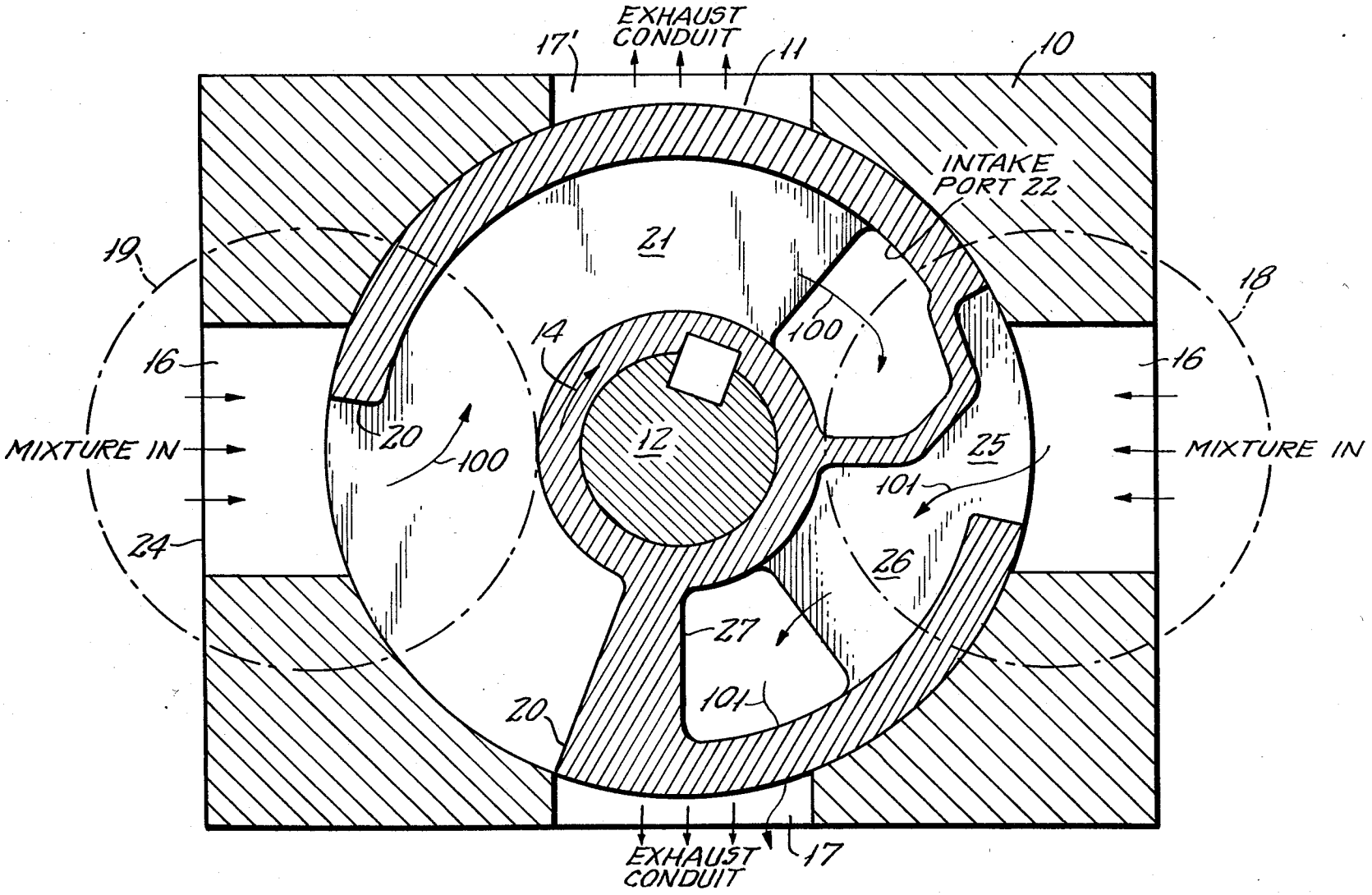
FIG. 1 is a schematic view showing an improved disk valve element comprising a part of the disclosed embodiment.

In accordance with the invention, reference is made to my above-mentioned prior patent for a general description of the cam engine, the details of which are incorporated by reference. Referring to FIG. 1, reference character 10 designates an improved valve housing in which an improved disk valve element 11 rotates. The element 11 has an axis of rotation through the center of a shaft 12, and a key interconnects the disk valve element 11 to the shaft. As seen in FIG. 1, the disk valve element rotates in the direction of the arrow 14, and includes intake ports 15 and 16 and exhaust ports 17, all of which overlie pistons 18 and 19 disposed therebeneath.

An intake port 20 on the valve element passes over the intake ports 16 in the cylinder heads on the intake stroke of the pistons 18 and 19. The intake gas-air mixture (not shown) passes through the intake port 20, through the passageway 21, and through the intake slot 22 in the body of the disk valve. The gas-air mixture enters the disk valve through the intake port for feeding into the cylinder 18 communicating with the housing 10.

The intake manifold is connected to the disk valve housing at the face of the intake port 24. Thus, the intake gas-air mixture enters the cylinder containing the piston 18 from the intake port in the disk valve housing that is located on the opposite side, thus enabling the gas-air mixture to travel through the disk valve, i.e., the passageway 21, a greater distance than it would if the gas-air mixture entered the housing port adjacent to the cylinder. The exhaust port 25 engages the cylinder head ports 16 and 17 during its cycle and it emits the exhaust gas through the adjacent exhaust port 17 and 17[1].

The purpose of this improvement is to improve the cooling of the disk valve which is desirable because of the thickness of the disk valve which always must remain slightly under that of the thickness of the housing. The slight resulting clearance maintains free rotation of the disk while yet maintaining compression.

Figure 2:
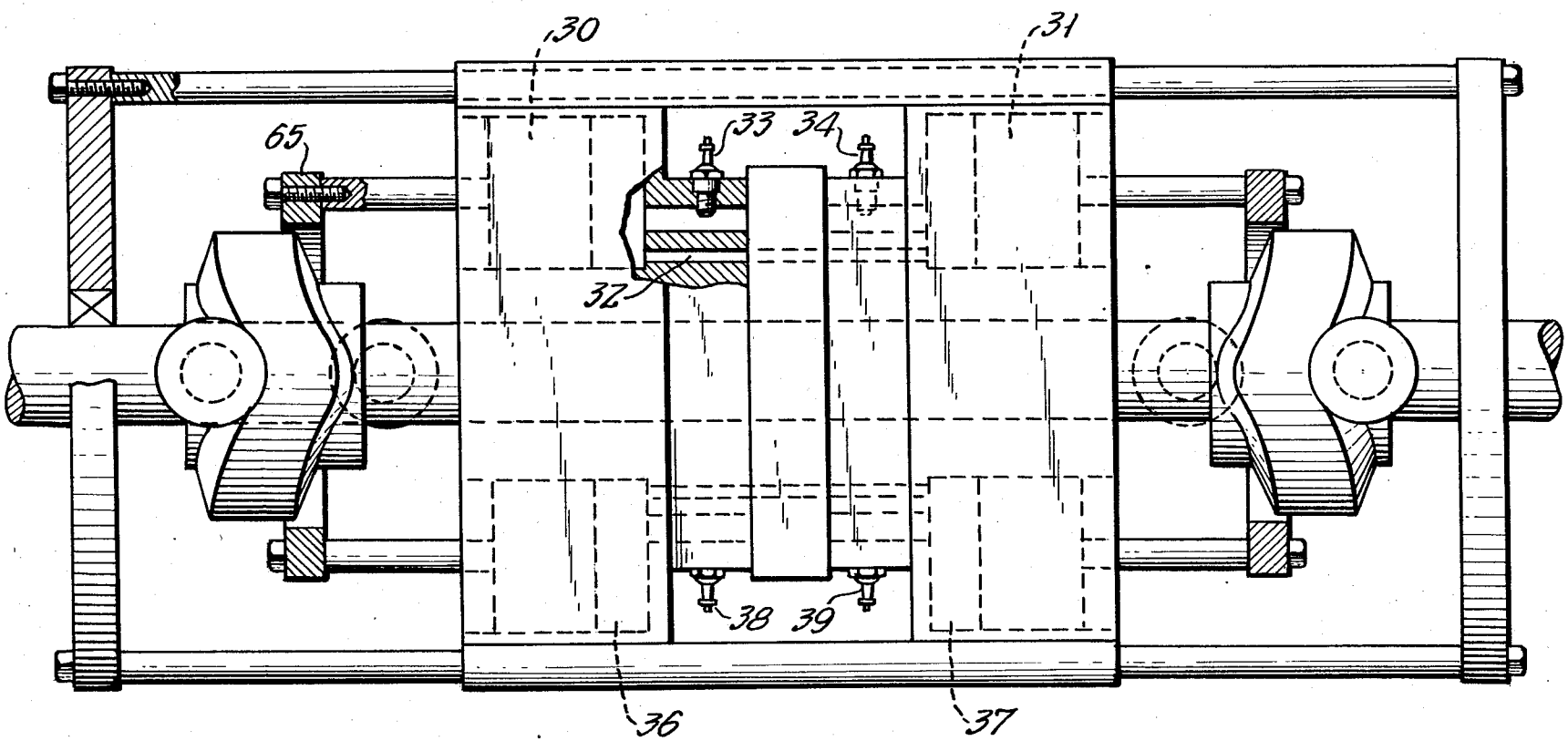
FIG. 2 is a schematic view showing the provision of dual ignition for each cylinder bank.

Referring to FIG. 2, there is illustrated a system of dual ignition which replaces the single ignition disclosed in my prior patent. Opposing pistons 30 and 31 fire at the same time in opposite directions. In my previous construction, the provision of a passage 32 allows the transmission of ignition to an oppositely disposed cylinder. In the present construction, spark plugs 33 and 34 are mounted in the heads of each cylinder block. Both spark plugs fire at the same time. The passage 32 is maintained to equalize pressure on both sides of the disk valve and to heat the disk valve housing 10 so that a clearance is maintained for the free rotation of the disk valve.

The same arrangement is also provided in cylinders 36 and 37 by spark plugs 38 and 39, these cylinders firing alternately to the cylinders containing the pistons 30 and 31.

Figure 3:
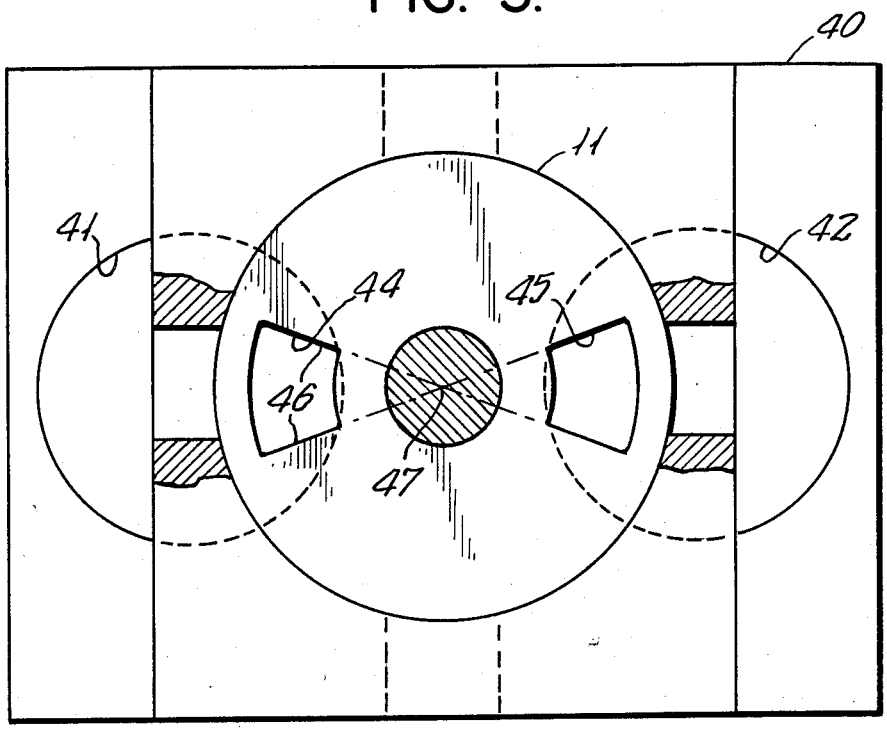
FIG. 3 is a schematic view showing converging surfaces forming intake and exhaust ports in a disk valve element.

Referring to FIG. 3 in the drawings, there is illustrated a disk valve having ports of improved configuration to permit rapid opening and closing, this being accomplished by having two opposed sides of the port of planar configuration and lying in planes which passes through the axis of rotation of the disk valve.

Reference character 40 designates a cylinder head containing cylinders 41 and 42 which the disk valve element 11 overlies. Intake and exhaust ports 44 and 45 are provided with converging planar sides 46, the planes of which pass through the center of rotation 47.

This arrangement provides for quicker opening and closing of the intake and exhaust cycles in the same degree of rotation of the drive shaft than would be the case if the ports were rounded. Further, more area for intake and exhaust gases is achieved in the same angle of rotation, thus improving the breathing characteristics of the engine.

Figure 4:
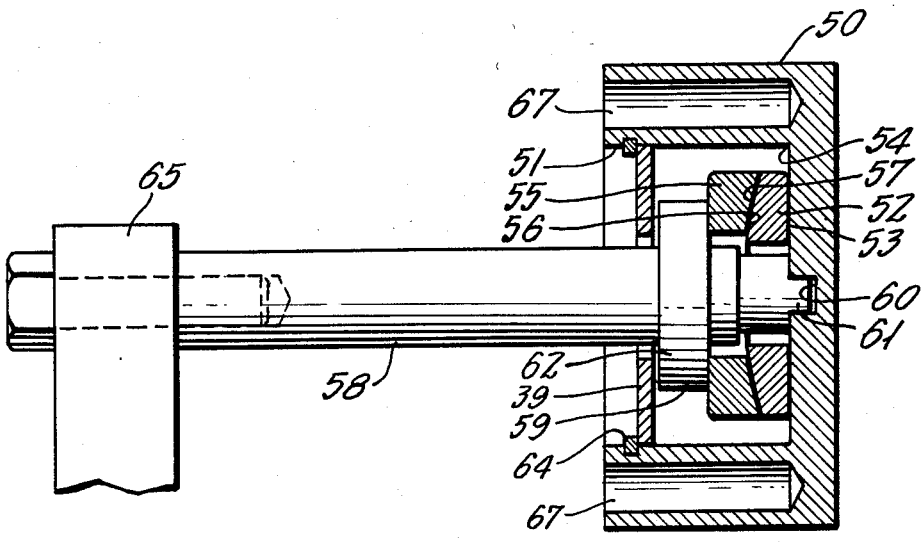
FIG. 4 is a schematic view showing self-aligning piston structure.

FIG. 4 illustrates a self-aligning piston construction which is desirable given the fact that the pistons and connecting rods in a cam type engine do not have relative pivotal motion therebetween as is the case in a conventional internal combustion engine. However, where no relative motion is possible, tolerances must be exceedingly fine, and this alignment will cause excessive pressure existing on one side of the piston with a related surface of the surrounding cylinder. The disclosed structure avoids this problem.

In FIG. 4, reference character 50 designates a piston having a centrally disposed axial bore or recess 51. A spherical washer 52 has an upper surface 53 in contact with the transverse surface 54 of the bore. A second washer 55 is disposed immediately therebeneath, and includes a spherical surface 56 which mates with a corresponding surface 57 on the washer 52. The connecting rod 58 is provided with a pilot shoulder 59 for locating the second washer 55.

A slot 60 in the piston 50 is penetrated by a tang 61 on the rod 58 to prevent relative rotation therebetween. A shoulder 62 on the rod 58 engages a plate 39 held in position by a retaining ring 64 to prevent axial movement between the rod and piston. A connecting plate 65 engages the opposite end of the connecting rod as in my earlier construction. Optional bores 67 are provided in the piston to lighten and cool the same. There is minimal clearance between the shoulder 62 and the plate 65 to allow for misalignment, and this clearance plus the ability of the piston to pivot slightly on the spherical surface of contact between the first and second washers 52 and 55 allows the piston sufficient freedom to avoid binding or scuffing. If desired, the washer 52 may be an integral part of the piston 50.

The result of the above structure permits limited pivotal and lateral movement to exist between the upper end of the connecting rod and the piston, while preventing rotation or axial movement of the piston relative to the connecting rod.

Figure 5:
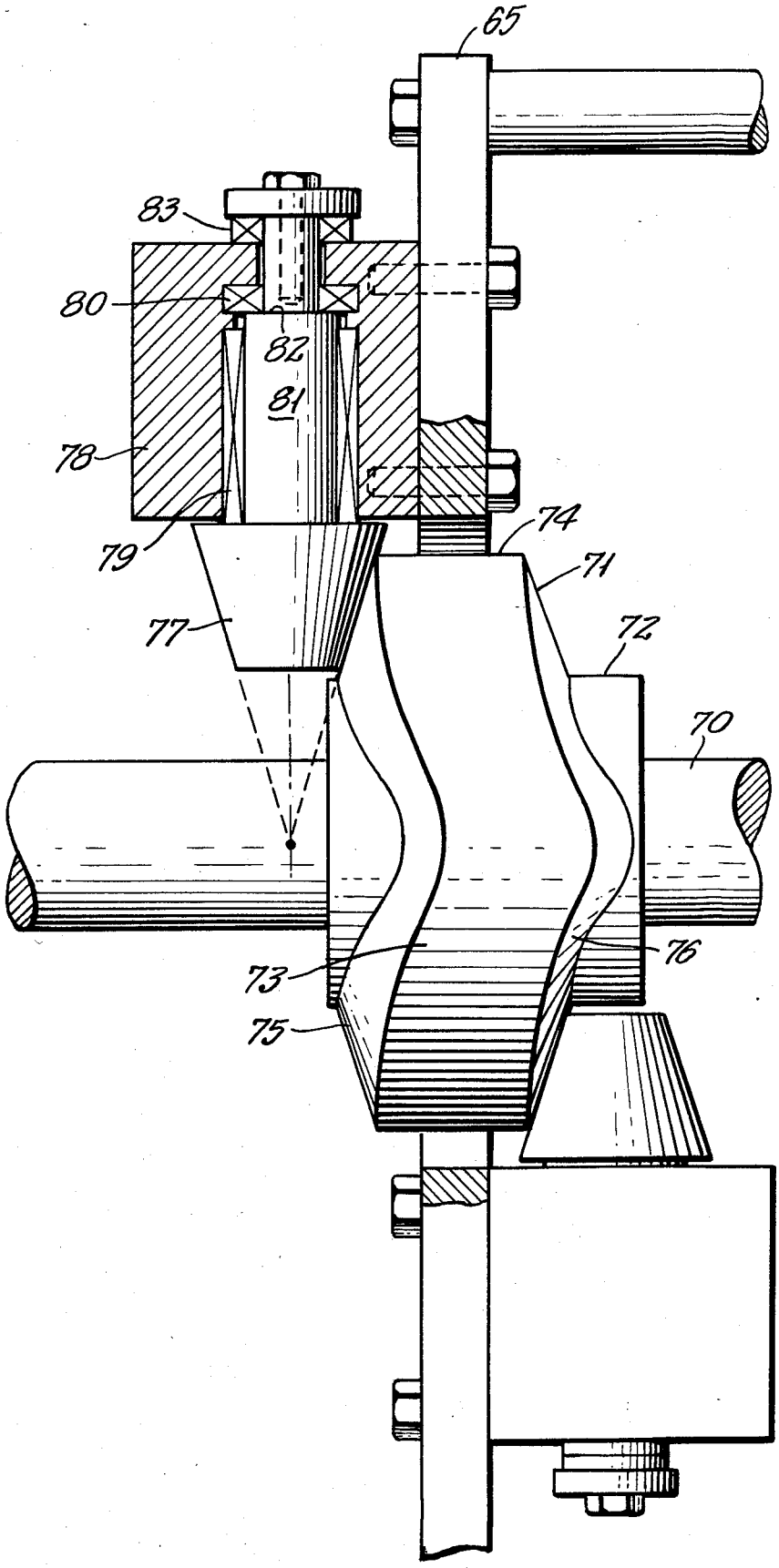
FIG. 5 is a schematic view showing improved bearing structure.

Referring to FIG. 5 in the drawings, there is illustrated an improved cam element and follower carried by the cam plate which provides smoother transmission of motion, and lowered friction.

The driven shaft 70 carries a cam element 71 which includes a sleeve 72 and a cam lobe 73. The lobe 73 is bounded by an outer surface 74 and camming surfaces 75 and 76, at least one of which engages a cam follower 77. The cam follower 77 is carried by a housing 78, in turn carried by the cam plates which connect with the lower end of the connecting rod.

Supporting the cam follower 77 is a radial bearing 79 and a thrust bearing 80 both of which support a cam follower shaft 81.

The shaft 81 has a shoulder 82 to transmit thrust to the bearing 80. A second thrust bearing 83 is mounted on the cam follower shaft 81 to retain the cam follower in the housing 78.

The above described structure provides for improved rolling action of the cam follower against the cam lobes with less or little friction. The load on the bearings in the cam follower housing is divided between the bearings 79 and 80 in convenient fashion.

Since the exposed surface of the cam follower 77 is also in the form of a frustum of a cone, with an apex also lying in the access of rotation of the output shaft, pure rolling between the cam and follower is possible.

It will thus be seen that I have invented new and highly useful improvements over my prior engine structure which materially improve its operational efficiency, without adding significantly to the cost of manufacture.

I wish it to be understood that I do not consider the invention limited to the precise details of structure shown and set forth in this specification, for obvious modifications will occur to those skilled in the art to which the invention pertains.

I claim:

1. In a disk valve structure in an internal combustion cam engine, said valve having an axis of rotation and disposed within a housing for feeding and exhausting fuel mixtures, said housing having on each side thereof a pair of cylinder blocks with each block having a pair of cylinders disposed on opposite sides of said axis of rotation, the improvement comprising: each of said cylinder blocks having at least one carbureting source adjacent each cylinder thereof, said disk valve being configured to conduct fuel mixture to each cylinder of each pair of blocks from said carbureting source disposed on the opposite cylinder of said respective block, whereby fuel mixture may absorb heat from said disk valve during an intake stroke of each individual cylinder.

2. A disk valve structure in accordance with claim 1 further improvement comprising: said disk valve having radially arranged ports thereon, said ports having walls in planes passing through said axis of rotation to enable maximum opening and closing for a given degree of rotation of said valve.

* * * * *